US008047460B2

(12) United States Patent
Eriksson et al.

(10) Patent No.: US 8,047,460 B2
(45) Date of Patent: Nov. 1, 2011

(54) GYRATORY CRUSHER, OUTER SHELL INTENDED THEREFORE AND METHODS FOR MOUNTING AND DISMOUNTING THE OUTER SHELL

(75) Inventors: Bengt-Arne Eriksson, Svedala (SE); Michael Saarnak, Malmö (SE)

(73) Assignee: Sandvik Intellectual Property AB, Sandviken (SE)

( * ) Notice: Subject to any disclaimer, the term of this patent is extended or adjusted under 35 U.S.C. 154(b) by 6 days.

(21) Appl. No.: 12/662,513

(22) Filed: Apr. 21, 2010

(65) Prior Publication Data

US 2010/0270409 A1 Oct. 28, 2010

(30) Foreign Application Priority Data

Apr. 22, 2009 (SE) ..... 0900534

(51) Int. Cl.
*B02C 2/00* (2006.01)

(52) U.S. Cl. ..... 241/207; 241/293; 29/426.1; 29/428

(58) Field of Classification Search ..... 241/207–216, 241/293–295; 29/426.1, 426.5, 428
See application file for complete search history.

(56) References Cited

U.S. PATENT DOCUMENTS

| | | | |
|---|---|---|---|
| 2,468,342 | A | 4/1949 | Munro |
| 3,459,383 | A | 8/1969 | Diemar |
| 2007/0272780 | A1 | 11/2007 | Olsson et al. |

FOREIGN PATENT DOCUMENTS

| | | |
|---|---|---|
| GB | 746 655 | 3/1956 |
| WO | WO 2008/139020 A1 | 11/2008 |

*Primary Examiner* — Mark Rosenbaum
(74) *Attorney, Agent, or Firm* — Drinker Biddle & Reath LLP

(57) ABSTRACT

A gyratory crusher has an outer shell, which is attachable in a frame having a frustoconical supporting surface, which is facing obliquely downwards and inwards. The outer shell has on the outer surface a collar, which has outer lugs, which are movable, from below, past the supporting surface and between inner lugs of a ring. The inner and outer lugs have mutually corresponding contact surfaces, which are adapted, by relative rotation of the ring and the outer shell, to be positioned opposite each other and, upon lifting of the ring, to lift also the outer shell so that a lower portion of the outer shell abuts the supporting surface of the frame. The contact surfaces of the inner and outer lugs are arranged such that lifting of the ring causes the outer lugs to be lifted by means of the inner lugs and brings the inner and outer lugs into radial abutment against each other.

15 Claims, 5 Drawing Sheets

GYRATORY CRUSHER, OUTER SHELL INTENDED THEREFORE AND METHODS FOR MOUNTING AND DISMOUNTING THE OUTER SHELL

CROSS-REFERENCE TO PRIOR APPLICATION

This application claims priority to Swedish Application No. 0900534-9 filed Apr. 22, 2009, which is incorporated by reference herein.

TECHNICAL FIELD

The present disclosure relates to a gyratory crusher, which has an outer shell, which is attachable in a frame forming part of the crusher and having a frustoconical supporting surface, which is facing obliquely downwards and inwards for supporting a lower portion on the outer surface of the outer shell. The outer shell has in the upper part on its outer surface a collar, which comprises a plurality of radially outwardly-extending outer lugs, which are movable, from below, past the frustoconical supporting surface and between the radially inwardly-extending inner lugs of a ring, which is vertically adjustable relative to the frame. The inner and outer lugs have mutually corresponding contact surfaces, which are adapted, by relative rotation of the ring and the outer shell, to be positioned in an at least partly overlapping manner and, upon lifting of the ring relatively to the frame, to lift also the outer shell, thereby bringing said lower portion of the outer shell into abutment against the supporting surface of the frame. The disclosure further concerns an outer shell intended for said crusher and methods for mounting and dismounting the outer shell.

BACKGROUND ART

A gyratory crusher as described by way of introduction is known from GB 746 655. In this crusher the outer shell is mounted in the frame in a comparatively simple manner by means of a kind of bayonet joint, which is formed by the collar of the outer shell and the corresponding ring of the frame. The bayonet joint makes it easy to move the relatively heavy outer shell into place in a starting position on the frame, from which position the final assembly can then be performed in a controllable manner by vertical adjustment of the ring relative to the frame, so that the lower portion of the outer shell is brought into abutment against the supporting surface of the frame.

SUMMARY

Even if the bayonet joint of the gyratory crusher according to GB 746 655 facilitates the mounting of the outer shell in the manner described above, the problem remains, for this crusher too, that an upper part of the outer shell must be supported on the outside by means of special backing elements. These backing elements are positioned between this upper part and a corresponding portion on the frame or the ring and ensure, together with the lower portion of the outer shell, which bears against the supporting surface of the frame, that the outer shell is securely held in place during operation of the gyratory crusher.

Because the backing elements are separate parts, which first have to be fitted before they are clamped in conjunction with the vertical adjustment of the ring, they make it more difficult to mount the outer shell in the frame. It will also be appreciated that they involve a potential risk of errors during mounting, a consequence of which may well be future interruptions of operations.

In view hereof it is an object to improve a gyratory crusher of the kind described by way of introduction in such a manner that the drawbacks associated with the prior art are obviated.

This object is achieved by a crusher of the kind described by way of introduction, in which the contact surfaces of the inner lugs are facing obliquely upwards and inwards and the contact surfaces of the outer lugs are facing obliquely downwards and outwards, so that when the contact surfaces are positioned in an at least partly overlapping manner lifting of the ring causes not only the outer lugs to be lifted by means of the inner lugs, but also the inner and outer lugs to be brought into radial abutment against each other. The inclined contact surfaces ensure that the outer shell is supported also at its upper end without the need for separate backing elements to be fitted in previously known manner. As a result, one operation of the mounting of the outer shell can be omitted, which reduces assembly time, and a potential source of error is eliminated, which contributes to improving the operational reliability.

In an embodiment of the invention, the frame has, above the frustoconical supporting surface, an internal circular supporting surface for supporting an outer circular portion of the ring. The internal circular supporting surface helps to significantly reduce the radial load on the ring, which is a considerable advantage in terms of operational reliability.

In a certain embodiment, the ring has a slot, which allows the diameter of the ring to be adjusted as the latter is being brought into said radial abutment. By virtue of the slot the ring can open or close in a controllable manner as it is being brought into said radial abutment, which is advantageous during mounting but also during operation, since no uncontrollable tensions will occur in the ring.

According to a further embodiment of the invention, the frame has, above the circular supporting surface, a flange in which bolt holes are provided for receiving bolts, which are connected to the ring and used for vertical adjustment of the ring. The flange and the bolt holes provided therein make it easy to carry out the required vertical adjustment of the ring, for example, from an easily accessible upper face of the flange.

In the embodiment involving the flange, the bolts comprise sleeves, which towards the ring have an internal screw thread, in which screws are screwed from the underside of the ring, and which towards the flange have an external screw thread, on which nuts are screwable. The sleeves can be designed to be extremely solid and are easier to mount than long, loose bolts. In addition, it is easy to secure the sleeves in a non-rotating manner in the ring by means of radial grooves in the upper face of the ring and corresponding flat portions on the sleeves.

According to the embodiment involving the flange, neck portions of nuts are conveniently inserted in the bolt holes from above, which neck portions are secured in the bolt holes by retaining rings located under the flange. The retaining rings ensure that the nuts are held in place at all times and, thus, that no unexpected obstacles occur during the assembly operation. Moreover, the retaining rings can advantageously be used also when dismounting the ring, wherein they, through abutment against the flange, force the ring away from its assembly position. Further, spring washers can be arranged on the neck portions on top of the flange, which spring washers further facilitate the mounting of the ring by smoothly taking up any uneven loads.

According to an alternative embodiment of the invention, the frame has, above the frustoconical supporting surface, an internal thread for engaging with a corresponding external thread on the ring, which threads enable, by rotation of the ring relatively to the frame, vertical adjustment of the ring relative to said frame. It will be appreciated that this too is a working solution for vertical adjustment, but that it does not afford as excellent adjustability as the solution involving the flange.

According to further embodiments of the invention, at least one of the inner lugs has at one side thereof a stop pin, which when the outer shell is inserted in the ring, limits their relative rotation. Limiting the rotation is advantageous during mounting, since it enables the contact surfaces of the inner and outer lugs to assume precisely defined relative positions.

According to one embodiment, the contact surfaces of the inner lugs are defined by segments of a frustoconical surface facing obliquely upwards and inwards, and the contact surfaces of the outer lugs are defined by segments of a frustoconical surface facing obliquely downwards and outwards. An advantage of having segments that form part of frustoconical surfaces is that it is easy to design such segments in a suitable manner, for example by turning.

According to further embodiments, there is provided, in addition to a gyratory crusher, also an outer shell intended for such a crusher, which outer shell is characterised in that it is frustoconical in shape and has in the lower part on the outer surface a frustoconical surface which is facing obliquely upwards and outwards and, in the upper part, a collar, which comprises a plurality of radially outwardly-extending outer lugs, which have contact surfaces facing obliquely downwards and outwards and which are movable, from below, past a frustoconical supporting surface of a frame of the crusher and between radially inwardly-extending inner lugs of a ring, which is vertically adjustable relative to the frame. The inner and outer lugs have mutually corresponding contact surfaces, which are adapted, by relative rotation of the ring and the outer shell, to be positioned in an at least partly overlapping manner and, upon lifting of the ring relative to the frame, to lift also the outer shell, thereby bringing said lower portion of the outer shell into abutment against the supporting surface of the frame. An outer shell of this kind can be easily provided and can be mounted in an extremely straightforward manner in a corresponding crusher without the need for any stability-enhancing backing elements.

For example, the contact surfaces of the outer lugs of such an outer shell are defined by segments of a frustoconical surface facing obliquely downwards and outwards. This is favourable in that it enables the contact surfaces of the outer lugs to be manufactured in a simple manner, for example by turning.

Methods for mounting and dismounting an outer shell in a gyratory crusher are also provided, which methods are distinguished by their relative simplicity as compared with prior art.

It is to be understood that both the foregoing general description and the following detailed description are exemplary and explanatory and are intended to provide further explanation of the invention as claimed.

BRIEF DESCRIPTION OF THE DRAWINGS

A particular embodiment of the invention will be described in more detail below, reference being made to the appended drawings, on which

DETAILED DESCRIPTION

Figure 1:
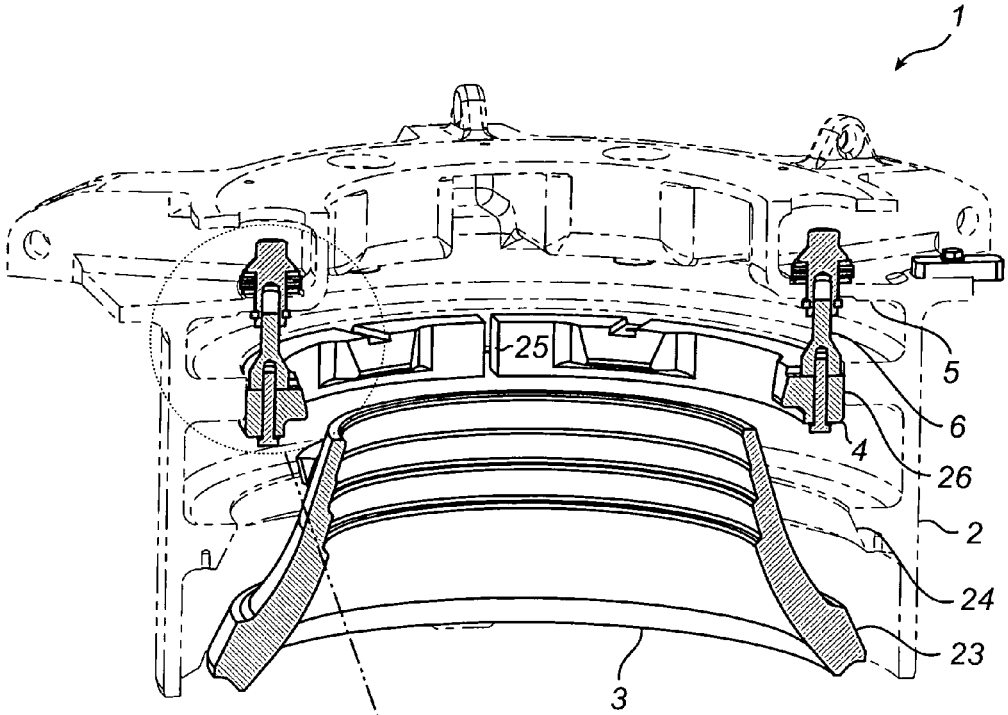
FIG. 1 is a vertical section taken through parts of a gyratory crusher in a first assembly position.
Figure 2:
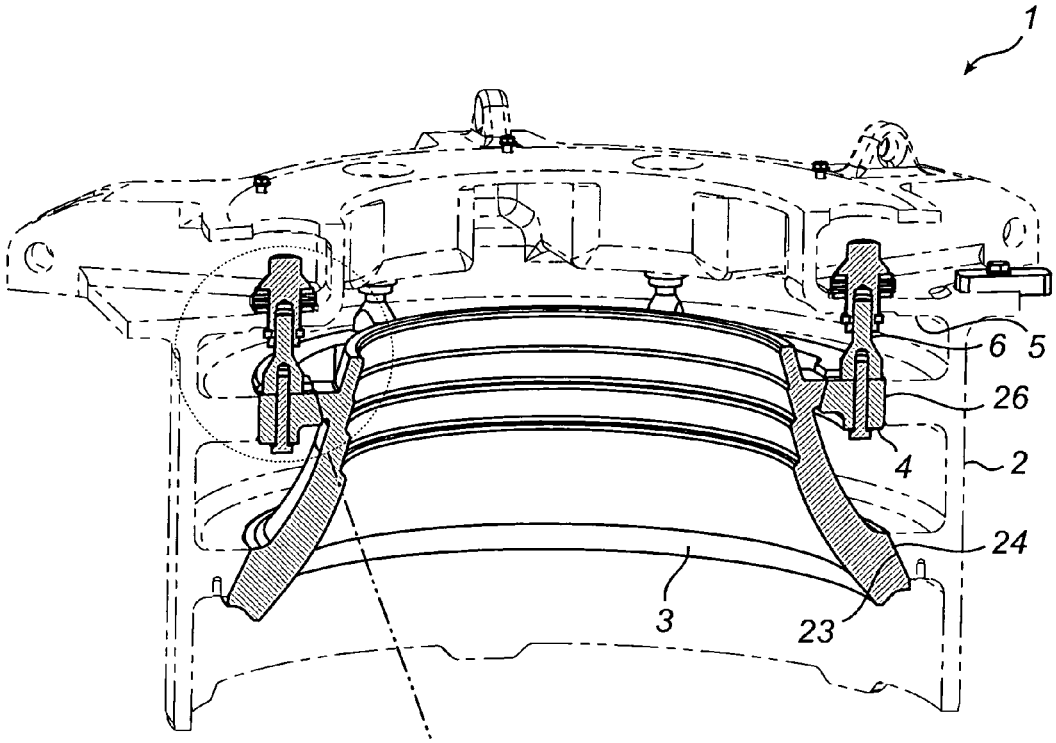
FIG. 2 is a vertical section taken through parts of the gyratory crusher in a second assembly position.

FIGS. 1 and 2 illustrate a gyratory crusher 1 according to a particular embodiment of the invention in two different positions. In the first position, which is shown in FIG. 1, a substantially circular-cylindrical frame 2 forming part of the crusher 1 is completely separated from a substantially frustoconical outer shell 3, whereas in the second position, which is shown in FIG. 2, the frame 2 and the outer shell 3 are fixedly attached to each other. Accordingly, the first position is a mounting position, which occurs for example when the outer shell 3 is being replaced, and the second position is a position of use, in which the outer shell 3, in a manner known in the art, is intended to cooperate with an inner shell (not shown) gyrating inside the outer shell 3.

Figure 1A:
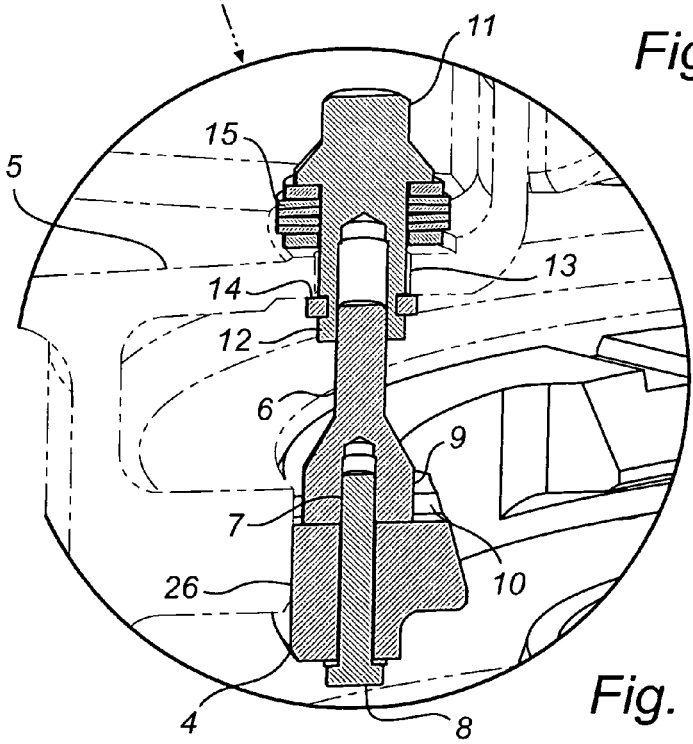
FIG. 1*a* is a vertical sectional view of a part of FIG. 1.

To achieve the fixed connection between the outer shell 3 and the frame 2 use is made, according to the invention, of a mounting ring 4, which is suspended from a circular flange 5 on the frame 2 by means of a plurality of threaded sleeves 6 spaced round the ring 4. Each such sleeve 6 has, as is evident from the detailed views in FIG. 1*a* and FIG. 2*a*, a base which is facing the ring 4 and in which a screw hole 7 is provided for receiving a screw 8, which extends into the screw hole 7 from the underside of the ring 4 for fixing of the sleeve 6 to the ring 4. Each sleeve 6 also has at the base thereof a flat portion 9 which, in cooperation with radial grooves 10 formed in the upper face of the ring 4, secures the screwed-on sleeve 6 to the ring 4 in a non-rotating manner.

Each sleeve 6 has in the upper part an external thread (not shown in detail), which is intended to engage with a respective nut 11, which rests against the upper face of the flange 5 of the frame 2. The flange 5 has a plurality of bolt holes 13 spaced along the flange 5 and adapted to receive the sleeves 6, or more particularly downwardly oriented neck portions 12 of the nuts 11, through which bolt holes said neck portions 12 extend so as to engage with the external threads of the sleeves 6. By turning the nuts 11 it is thus possible, in a simple manner, to adjust the ring 4 in the vertical direction relatively to the flange 5 of the frame 2.

To prevent the nuts 11 from falling off by accident, for example when replacing the mounting ring 4, the neck portions 12 of the nuts 11 are secured in the bolt holes 13 of the flange 5 by means of retaining rings 14 located under the flange 5. Advantageously, the retaining rings 14 can also be used, together with the nuts 11, for forcing the mounting ring 4 away from the flange 5 during dismounting of the outer shell 3. Spring washers 15 are suitably fitted to the neck portions 12 on the upper face of the flange 5 between the flange 5 and the nuts 11, which spring washers 15 contribute to taking up any uneven loads on the ring 4 and the associated sleeves 6.

Figure 3A:
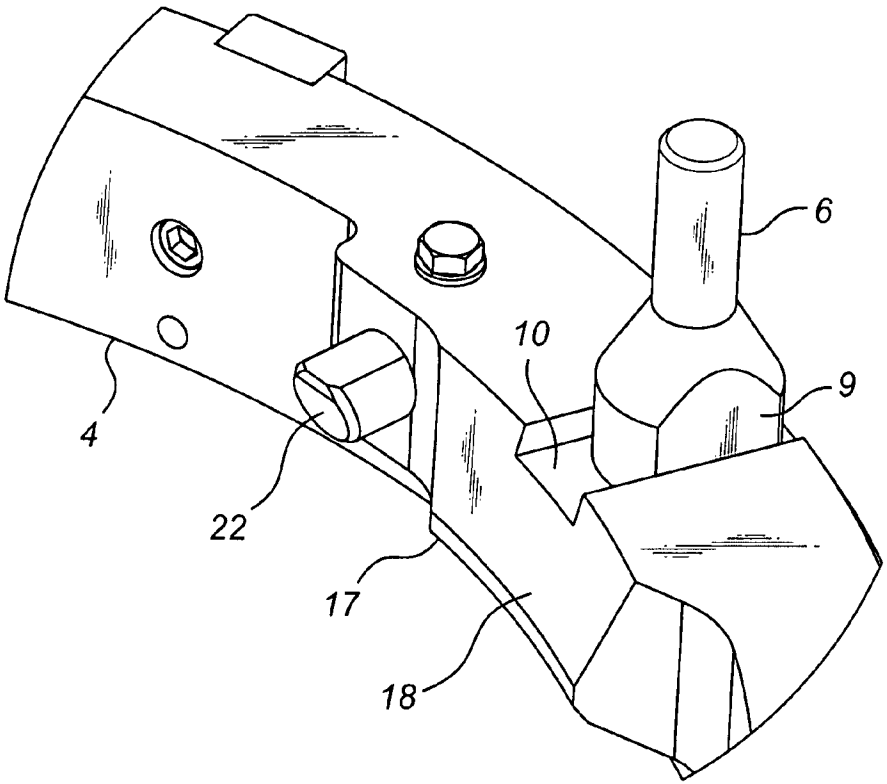
FIG. 3*a* is a perspective view of a part of FIG. 3.
Figure 3:
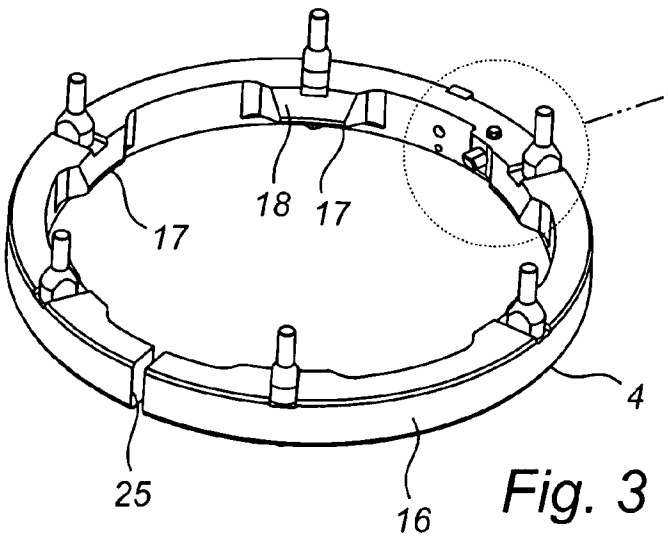
FIG. 3 is a perspective view of a mounting ring for the gyratory crusher.

The mounting ring 4, which as stated above is suspended from the flange 5 of the frame 2 in a vertically adjustable manner, has, as is evident from FIGS. 3 and 3*a*, a substantially circular-cylindrical outer surface 16 and an inner surface with a plurality of radially inwardly-extending inner lugs 17. These inner lugs 17 have towards the center of the ring 4 contact surfaces 18, which are segments of a frustoconical surface oriented obliquely upwards and inwards like a funnel.

Figure 4A:
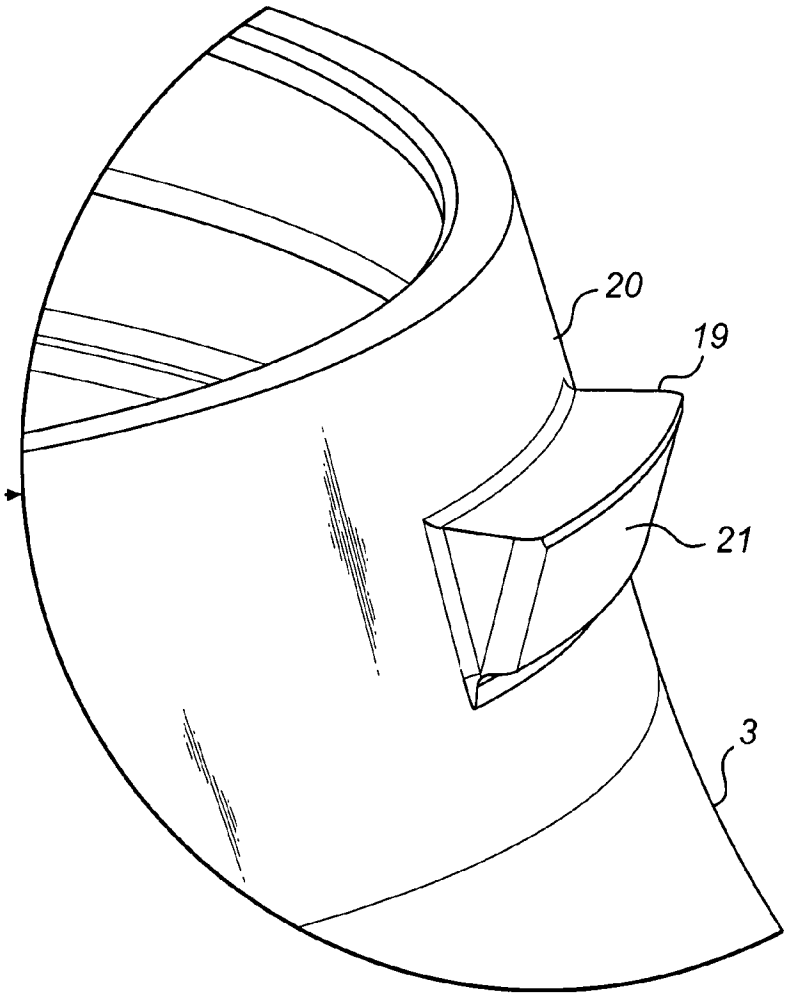
FIG. 4*a* is a perspective view of a part of FIG. 4.
Figure 4:
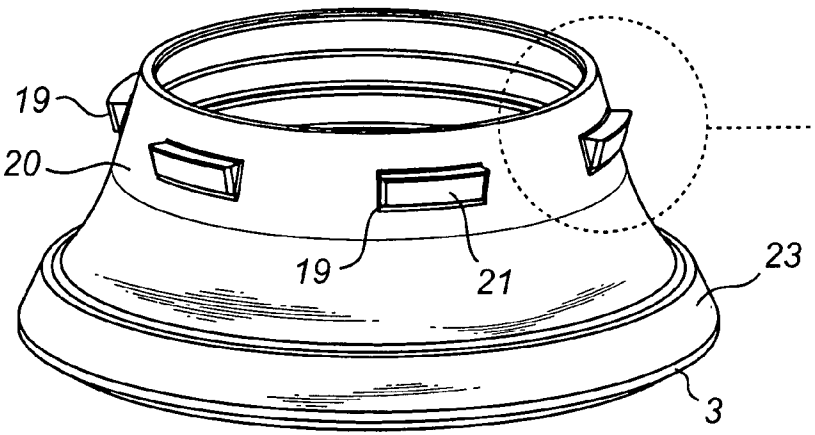
FIG. 4 is a perspective view of an outer shell for the gyratory crusher.

Corresponding to the inner lugs 17 of the mounting ring 4 the outer shell 3 has, as is evident form FIGS. 4 and 4*a*, a plurality of radially outwardly-extending outer lugs 19, which are spaced along an annular collar 20 on the outside of an upper portion of the outer shell 3. The outer lugs 19 have outwardly oriented contact surfaces 21, which are segments of a frustoconical surface oriented obliquely downwards and outwards like an inverted funnel.

Figure 2A:
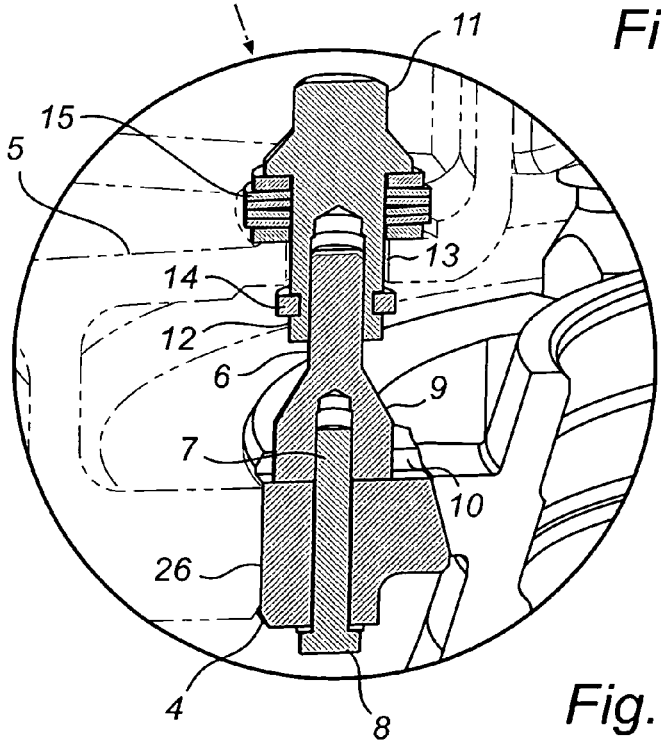
FIG. 2*a* is a vertical sectional view of a part of FIG. 2.
Figure 5:
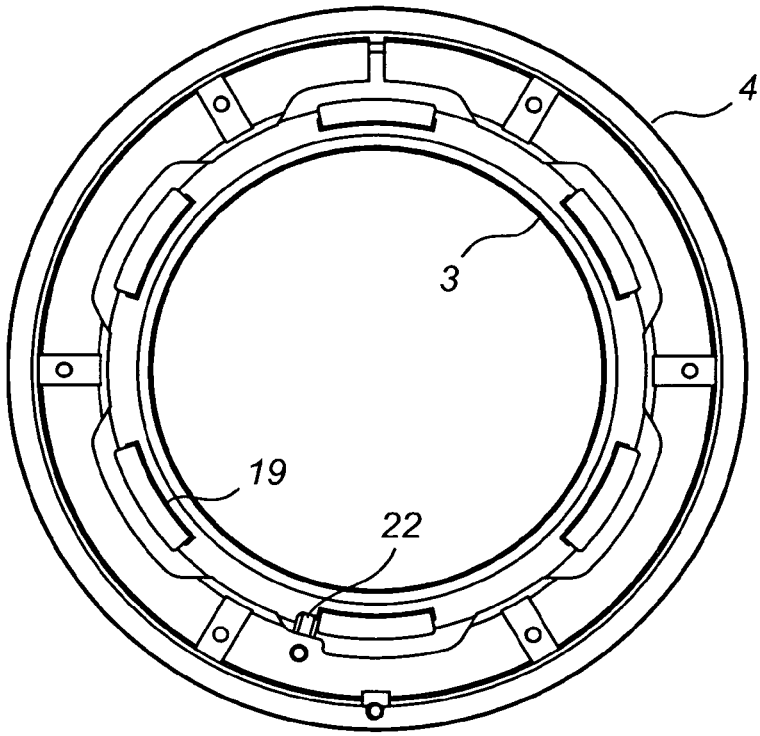
FIG. 5 is a view from above of the mounting ring and the outer shell in a disengaged position.
Figure 6:
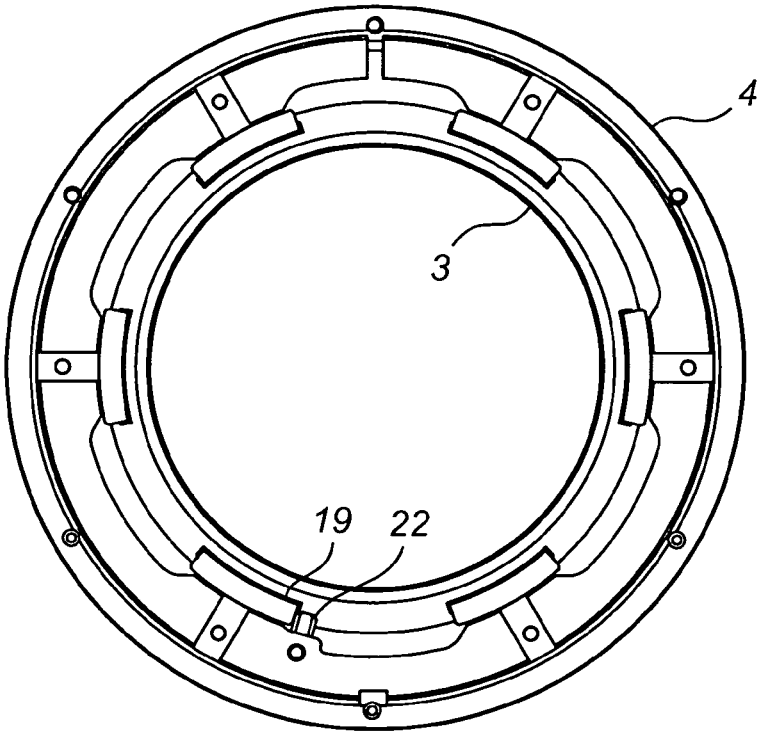
FIG. 6 is a view from above of the mounting ring and the outer shell in a locking position.

The lugs 17, 19 are provided in corresponding numbers and their contact surfaces 18, 21 are complementary in that the outer lugs 19, for the purpose of mounting the outer shell 3 in the frame 2 of the crusher 1, are movable, from below, past the inner lugs 17 (see FIG. 5) so as to be suspended from the ring 4 after a limited rotation of the outer shell 3 relatively to the ring (see FIG. 6), the contact surfaces 18, 21 being in close contact with each other (see FIGS. 2 and 2*a*). Suitably, the rotation is limited by a stop pin 22, which is arranged on the inside of the ring 4 and clearly visible in FIG. 3*a*. The pin 22 is adapted, in the desired position of rotation, to engage with one of the outer lugs 19 of the outer shell 3 (see FIG. 6).

Once the outer shell 3 is suspended from the ring 4, as described above, the nuts 11 are tightened so that the ring 4 is lifted relatively to the flange 5 of the frame 2. As a result, also the outer shell 3 is lifted until a lower outer portion 23 of the same is brought into fixed engagement with an obliquely downwardly facing annular supporting surface 24 on the frame 2. In this position, the contact surfaces 18, 21 of the inner and outer lugs 17, 19 are pressed hard against each other in both the axial and the radial direction due to the inclination of these surfaces. The ring 4 is capable of compensating any unwanted uneven loads due to a slot 25, which allows the diameter of the ring 4 to be adjusted and the ring 4 to be brought into radial abutment against an internal circular supporting surface 26 on the frame 2 between the flange 5 and the frustoconical supporting surface 24.

It will be appreciated that the embodiment set out above can be modified in various ways within the scope of the appended claims. Accordingly, it is possible, for example, to replace the mounting ring 4 described above by a screw ring of a type resembling that which is used in the crusher disclosed in GB 746 655 referred to above.

Although described in connection with preferred embodiments thereof, it will be appreciated by those skilled in the art that additions, deletions, modifications, and substitutions not specifically described may be made without departure from the spirit and scope of the invention as defined in the appended claims.

The invention claimed is:

1. A gyratory crusher comprising an outer shell, which is attachable in a frame forming part of the crusher and having a frustoconical supporting surface which is facing obliquely downwards and inwards for supporting a lower portion on the outer surface of the outer shell, the outer shell having in the upper part on its outer surface a collar, which comprises a plurality of radially outwardly-extending outer lugs, which are movable, from below, past the frustoconical supporting surface and between radially inwardly-extending inner lugs of a ring, which is vertically adjustable relative to the frame, the inner and outer lugs having mutually corresponding contact surfaces, which are adapted, by relative rotation of the ring and the outer shell, to be positioned in an at least partly overlapping manner and, upon lifting of the ring relatively to the frame, to lift also the outer shell, thereby bringing said lower portion of the outer shell into abutment against the supporting surface of the frame, wherein the contact surfaces of the inner lugs are facing obliquely upwards and inwards and the contact surfaces of the outer lugs are facing obliquely downwards and outwards, so that when the contact surfaces are positioned in an at least partly overlapping manner lifting of the ring causes not only the outer lugs to be lifted by means of the inner lugs, but also the inner and outer lugs to be brought into radial abutment against each other.

2. The crusher according to claim 1, wherein the frame has, above the frustoconical supporting surface, an internal circular supporting surface for supporting an outer circular portion of the ring.

3. The crusher according to claim 2, wherein the ring has a slot, which allows the diameter of the ring to be adjusted as the latter is being brought into said radial abutment.

4. The crusher according to claim 2, wherein the frame has, above the internal circular supporting surface, a flange in which bolt holes are provided for receiving bolts, which are connected to the ring and used for vertical adjustment of the ring.

5. The crusher according to claim 4, wherein the bolts comprise sleeves, which towards the ring have an internal screw thread, in which screws are screwed from the underside of the ring, and which towards the flange have an external screw thread, on which nuts are screwable.

6. The crusher according to claim 5, wherein the sleeves are secured in a non-rotating manner in the ring by means of radial grooves in the upper surface of the ring and corresponding flat portions on the sleeves.

7. The crusher according to claim 5, wherein neck portions of nuts are inserted in the bolt holes from above, which neck portions are secured in the bolt holes by means of retaining rings located under the flange.

8. The crusher according to claim 7, wherein spring washers are arranged on the neck portions on top of the flange.

9. The crusher according to claim 1, wherein the frame has, above the frustoconical supporting surface, an internal thread for engaging with a corresponding external thread on the ring, which threads enable, by rotation of the ring relatively to the frame, vertical adjustment of the ring relative to said frame.

10. The crusher according to claim 1, wherein at least one of the inner lugs has at one side thereof a stop pin, which when the outer shell is inserted in the ring limits their relative rotation.

11. The crusher according to claim 1, wherein the contact surfaces of the inner lugs are defined by segments of a frustoconical surface facing obliquely upwards and inwards, and the contact surfaces of the outer lugs are defined by segments of a frustoconical surface facing obliquely downwards and outwards.

12. An outer shell for a gyratory crusher comprising a frame having a frustoconical supporting surface which is facing obliquely downwards and inwards for supporting a lower portion on the outer surface of the outer shell, wherein the outer shell is frustoconical in shape and has in the lower part on the outer surface a frustoconical surface, which is facing obliquely upwards and outwards and, in the upper part, a collar, which comprises a plurality of radially outwardly-extending outer lugs, which have contact surfaces facing obliquely downwards and outwards and which are movable, from below, past the frustoconical supporting surface and between radially inwardly-extending inner lugs of a ring, which is vertically adjustable relative to the frame, the inner and outer lugs having mutually corresponding contact surfaces, which are adapted, by relative rotation of the ring and the outer shell, to be positioned in an at least partly overlapping manner and, upon lifting of the ring relatively to the frame, to lift also the outer shell, thereby bringing said lower portion of the outer shell into abutment against the supporting surface of the frame.

13. The outer shell according to claim 12, wherein the contact surfaces of the outer lugs are defined by segments of a frustoconical surface facing obliquely downwards and outwards.

14. A method for mounting an outer shell in a gyratory crusher, comprising the steps of inserting, from below, the outer shell in a frame of the crusher in such a manner that a collar provided with a plurality of radially outwardly-extending outer lugs, which have contact surfaces facing obliquely downwards and outwards, is moved upwards between a plurality of radially inwardly-extending inner lugs, which have contact surfaces facing obliquely upwards and inwards and which are arranged on a ring, which is connected to the frame; rotating the outer shell and the ring relatively to each other, so that the contact surfaces of the outer shell and the ring are positioned in an at least partly overlapping manner; and then clamping the outer shell and the ring to the frame by lifting the ring relatively to the frame, wherein, by lifting, a lower portion of the outer shell is brought into abutment against an internal conical supporting surface of the frame and the ring is brought into abutment against an internal circular supporting surface of the frame.

15. A method for dismounting an outer shell in a gyratory crusher, in which the outer shell was mounted by performing the steps of inserting, from below, the outer shell in a frame of the crusher in such a manner that a collar provided with a plurality of radially outwardly-extending outer lugs, which have contact surfaces facing obliquely downwards and outwards, is moved upwards between a plurality of radially inwardly-extending inner lugs, which have contact surfaces facing obliquely upwards and inwards and which are arranged on a ring, which is connected to the frame; rotating the outer shell and the ring relatively to each other, so that the contact surfaces of the outer shell and the ring are positioned in an at least partly overlapping manner; and then clamping the outer shell and the ring to the frame by lifting the ring relatively to the frame, wherein, by lifting, a lower portion of the outer shell is brought into abutment against an internal conical supporting surface of the frame and the ring is brought into abutment against an internal circular supporting surface of the frame, comprising the steps of forcing the ring downwards away from its position of abutment against the internal circular supporting surface and then completely disengaging the outer shell by rotating the outer shell and the ring relatively to each other.

* * * * *